US009160146B2

(12) United States Patent
Sakakura et al.

(10) Patent No.: US 9,160,146 B2
(45) Date of Patent: Oct. 13, 2015

(54) SPARK PLUG

(71) Applicant: NGK Spark Plug Co., LTD., Nagoya (JP)

(72) Inventors: Yasushi Sakakura, Ichinomiya (JP); Yukinobu Hasegawa, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 14/506,141

(22) Filed: Oct. 3, 2014

(65) Prior Publication Data

US 2015/0102720 A1 Apr. 16, 2015

(30) Foreign Application Priority Data

Oct. 11, 2013 (JP) ..... 2013-213516

(51) Int. Cl.
*H01T 13/20* (2006.01)
*H01T 13/39* (2006.01)
*H01T 21/02* (2006.01)

(52) U.S. Cl.
CPC ..... *H01T 13/39* (2013.01); *H01T 21/02* (2013.01)

(58) Field of Classification Search
CPC ..... H01T 13/20; H01T 13/39; H01T 21/02
See application file for complete search history.

(56) References Cited

U.S. PATENT DOCUMENTS

2002/0003389 A1 1/2002 Ishiguro
2002/0105254 A1* 8/2002 Hori et al. ..... 313/141
2005/0023949 A1* 2/2005 Hori ..... 313/141
2005/0134160 A1 6/2005 Yamanaka
2007/0128964 A1 6/2007 Hori
2009/0289539 A1 11/2009 Sakakura
2010/0264802 A1* 10/2010 Tanaka et al. ..... 313/141

FOREIGN PATENT DOCUMENTS

JP 2002-93547 A 3/2002
JP 2005-50732 A 2/2005
JP 2005-183167 A 7/2005
JP 2007-87969 A 4/2007
JP 2009-283262 A 12/2009
JP 4705129 B 6/2011
JP 2013-012314 A 1/2013

OTHER PUBLICATIONS

European Search Report mailed Feb. 12, 2015 for the corresponding European Application No. 14187747.2.

* cited by examiner

*Primary Examiner* — Donald Raleigh
(74) *Attorney, Agent, or Firm* — Leason Ellis LLP

(57) ABSTRACT

A spark plug includes an electrode wherein a plurality of fusion regions are formed by melting to each other a circular noble metal tip having a diameter of not less than 2 mm and a base material disposed around an outer periphery of the noble metal tip. In a particular tip cross section, a total length of the portions passing the fusion region on the circumference of a circle A concentric to an outline of the tip and having a diameter of 90% of the length of the tip is not less than 30% of the length of the circumference of the concentric circle A, and a total length of the portions on which a circumference of a concentric circle B, having the same diameter as that of the outline passes, is not less than 30% of the length of the circumference of the concentric circle B.

9 Claims, 14 Drawing Sheets

FIG. 9

| | | RATIO OVER CONCENTRIC CIRCLE B (%) | | |
|---|---|---|---|---|
| | | 20 | 30 | 50 |
| RATIO OF FUSION DEPTH k TO DIAMETER OF CONCENTRIC CIRCLE B (%) | 2 | POOR | POOR | POOR |
| | 5 | POOR | GOOD | GOOD |
| | 10 | POOR | GOOD | EXCELLENT |

FIG. 10

| | RATIO OVER CONCENTRIC CIRCLE A (%) | | |
|---|---|---|---|
| | 20 | 30 | 50 |
| JOINT STRENGTH | POOR | GOOD | GOOD |

| | | HEATING TEMPERATURE (°C) | |
|---|---|---|---|
| | | 800 | 1000 |
| RATIO OF NOBLE METAL IN 2ND OUTER PERIPHERAL FUSION PORTION D (MASS%) | 5 | EXCELLENT | EXCELLENT |
| | 10 | EXCELLENT | EXCELLENT |
| | 11 | EXCELLENT | GOOD |

SPARK PLUG

This application claims priority from Japanese Patent Application Nos. 2013-213516 filed with the Japan Patent Office on Oct. 11, 2013, the entire contents of which are hereby incorporated by reference.

BACKGROUND OF THE INVENTION

1. Technical Field

The present disclosure relates to spark plugs.

2. Related Art

A spark plug is known in which an electrode tip is joined in a center electrode or a ground electrode (either of which may be hereafter referred to simply as "an electrode") (see JP Patent No. 4705129, for example). The electrode tip (hereafter referred to as "a noble metal tip") is formed from a noble metal (such as platinum, iridium, ruthenium, or rhodium) having excellent spark erosion resistance and oxidation resistance, or an alloy composed chiefly of a noble metal. Generally, the noble metal tip is joined in a base material (an electrode or an intermediate member for joining with the electrode) by laser welding. Specifically, the noble metal tip is joined to the base material by irradiating the noble metal tip with laser along an outer periphery thereof.

As other relevant literature, JP-A-2002-93547, JP-A-2005-183167, JP-A-2007-87969, and JP-A-2005-50732 may be cited.

SUMMARY OF THE INVENTION

A spark plug includes an electrode, the electrode including a noble metal tip formed in a circular cross-sectional shape and containing a noble metal and a base material disposed around an outer periphery of the noble metal tip, in which the noble metal tip is welded to the base material and a fusion region extending from the base material to the noble metal tip is formed by melting the base material and the noble metal tip into each other. The noble metal tip has a diameter of not less than 2 mm; in a cross section perpendicular to a central axis CL1 of the noble metal tip and passing a point closest to the central axis CL1 in the fusion region, the fusion region includes a plurality of central fusion portions formed in a central area of the noble metal tip with respect to a circumference of a circle A concentric to an outline of the noble metal tip, the concentric circle A having a diameter corresponding to a length of 90% of the diameter of the noble metal tip; a total of lengths on the concentric circle A in the fusion region positioned over the concentric circle A is not less than 30% of the length of the circumference of the concentric circle A; and a total of lengths on a concentric circle B in the fusion region positioned over the concentric circle B having the same diameter as the diameter of the outline of the noble metal tip is not less than 30% of the length of the circumference of the concentric circle B.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 9 is an explanatory diagram illustrating the results of an examination of the joint strength between the noble metal tip and a holding member;

FIG. 10 is an explanatory diagram illustrating the results of an examination of the joint strength between the noble metal tip and the holding member;

DETAILED DESCRIPTION OF THE INVENTION

Figure 1:
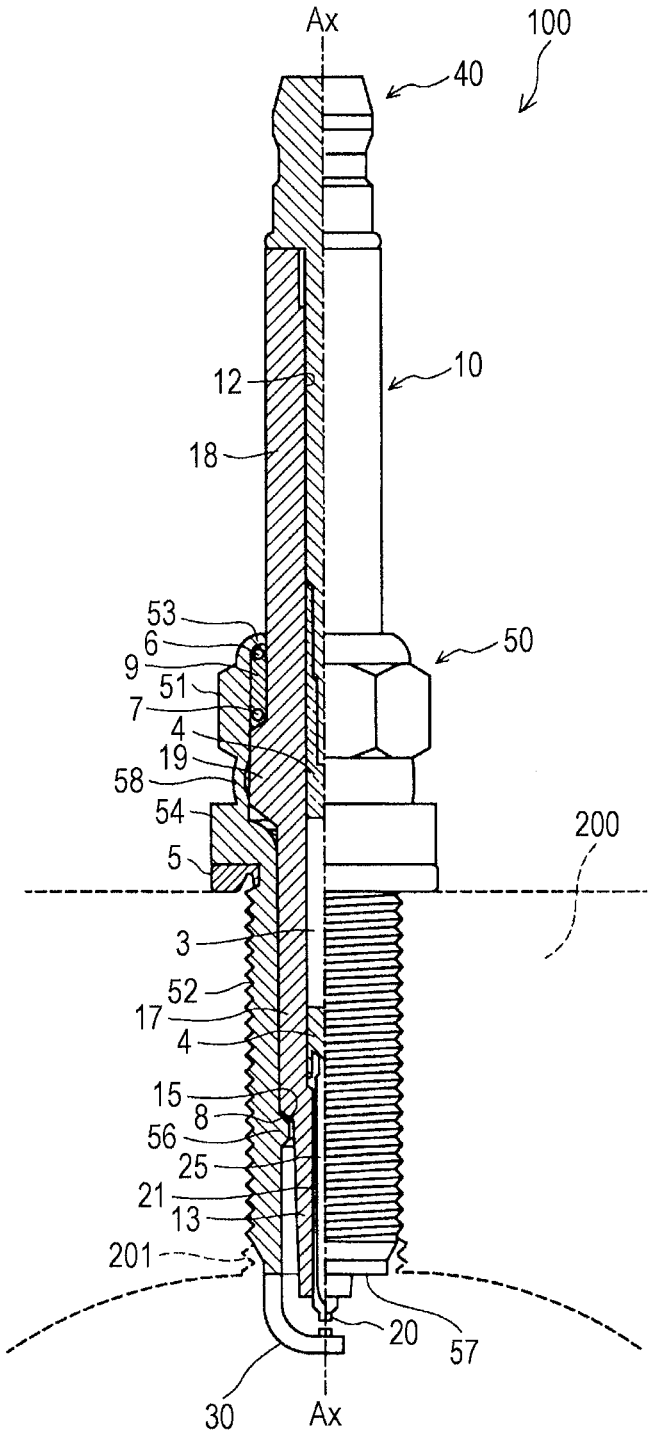
FIG. 1 is a partial cross-sectional view of a spark plug.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

As the noble metal tip, a relatively large sized tip, particularly one with the diameter of not less than 2 mm, may in some cases be used. In such cases, instead of continuously irradiating the noble metal tip with laser along the entire outer periphery thereof, laser irradiation may be performed at a plurality of locations along the outer periphery of the noble metal tip. In this case, as a method for increasing the joint strength of the noble metal tip, there may be considered a method whereby the laser irradiation output per each location is increased, or a method whereby the number of locations for laser irradiation is increased. These methods make it possible to expand the fusion region formed by laser irradiation in which the noble metal tip and the base material are melted into each other.

The above methods attempt to increase the joint strength of the noble metal tip by expanding the fusion region by increasing the amount of energy applied by laser irradiation. However, when the electrode is exposed to a thermal cycle during the use of the spark plug, it sometimes becomes difficult to sufficiently ensure the durability of the noble metal tip. For example, when the amount of energy applied by laser irradiation is increased, the noble metal content in the fusion region generally increases. As a result of an increase in the noble metal content in the fusion region, the difference in linear expansion coefficient between the fusion region and the base material increases. Thus, as the electrode is exposed to the thermal cycle, the noble metal tip becomes more likely to fall off the base material.

Further, when an intermediate member is used as the base material, as the amount of energy applied by laser irradiation is increased, the temperature of the base material at the time of laser irradiation increases. As a result, the base material becomes more likely to be deformed. If the noble metal tip welded to the deformed base material is joined to the electrode, clearance is created between the base material and the electrode. As a result, the efficiency of thermal conduction from the noble metal tip to the electrode decreases. When the thermal conduction efficiency from the noble metal tip to the electrode is decreased, the noble metal tip and base material may become overheated when a spark is formed in the spark plug. Thus, the noble metal tip becomes more likely to fall off. Accordingly, there is a need for increasing the joint strength of the noble metal tip, and to suppress the noble metal tip from falling from the electrode exposed to a thermal cycle.

The spark plug according to embodiments of the present disclosure can be realized as plugs having the following aspects.

(1) According to an aspect of the present disclosure, provided is a spark plug including an electrode, the electrode including a noble metal tip formed in a circular cross-sectional shape and containing a noble metal and a base material disposed around an outer periphery of the noble metal tip, in which the noble metal tip is welded to the base material and a fusion region extending from the base material to the noble metal tip is formed by melting the base material and the noble metal tip into each other. In this spark plug, the noble metal tip has a diameter of not less than 2 mm; in a cross section perpendicular to a central axis CL1 of the noble metal tip and passing a point closest to the central axis CL1 in the fusion region, the fusion region includes a plurality of central fusion portions formed in a central area of the noble metal tip with respect to a circumference of a circle A concentric to an outline of the noble metal tip, the concentric circle A having a diameter corresponding to a length of 90% of the diameter of the noble metal tip; a total of lengths on the concentric circle A in the fusion region positioned over the concentric circle A is not less than 30% of the length of the circumference of the concentric circle A; and a total of lengths on a concentric circle B in the fusion region positioned over the concentric circle B having the same diameter as the diameter of the outline of the noble metal tip is not less than 30% of the length of the circumference of the concentric circle B.

In the spark plug according to this aspect, the fusion region having a shape with a plurality of central fusion portions is formed using a noble metal tip having a relatively large diameter of not less than 2 mm. Thus, even when the noble metal tip and the base material are welded, the volume of the fusion region formed in the noble metal tip can be ensured, and, as a result, the joint strength between the noble metal tip and the base material can be increased. Further, the fall of the noble metal tip from the base material can be suppressed.

(2) In the spark plug according to the above aspect, in the fusion region, a content ratio of a metal constituting the noble metal tip in a portion overlapping the circumference of the concentric circle B in the cross section may not be more than 10 mass %.

In the spark plug according to this aspect, the difference in linear expansion coefficient between the fusion region and the noble metal tip is further increased. As a result, the difference in linear expansion coefficient between the fusion region and the base material is decreased. Accordingly, even if cracks are caused as the spark plug is exposed to a thermal cycle, the cracks tend to be caused at the boundary portion of the noble metal tip and the fusion region formed inside the noble metal tip rather than in other locations. Thus, the fall of the noble metal tip from the base material can be suppressed.

(3) In the spark plug according to the above aspect, the fusion region may include a plurality of mutually spaced-apart independent fusion portions including any of the central fusion portions; and in the cross section, a central axis CL2 of each of the independent fusion portions may be spaced apart from a line parallel with the central axis CL2 and passing the central axis CL1 of the noble metal tip.

In the spark plug according to this aspect, in each of the independent fusion portions, the length on the concentric circle A and the length on the concentric circle B become longer. Thus, the number of the independent fusion portions formed can be reduced so that, when the fusion region is formed, the amount of energy (amount of heat) applied to the noble metal tip and the base material as a whole can be contained. As a result, deformation of the base material during the formation of the fusion region can be suppressed, whereby the durability of the electrode can be increased.

(4) In the spark plug according to the above aspect, the central axis CL2 of each of the independent fusion portions may be spaced on the same side apart from the line parallel with the central axis CL2 and passing the central axis CL1 of the noble metal tip.

In the spark plug according to this aspect, it becomes easier to ensure the total of the lengths of the circumference of the concentric circle B passing each of the independent fusion portions, and the total of the lengths of the circumference of the concentric circle A passing each of the independent fusion portions in the electrode as a whole. Further, the operation for forming the fusion regions can be simplified. As a result, processability can be increased.

(5) In the spark plug according to the above aspect, the noble metal tip may be formed from iridium or an iridium alloy.

In the spark plug according to this aspect, the difference in linear expansion coefficient between the noble metal tip and the fusion region and base material is increased. Thus, the effect of increasing the durability of the electrode by increasing the joint strength between the noble metal tip and the base material can be particularly significantly obtained.

Other than the above, various embodiments may be realized. For example, an aspect as a method for manufacturing a spark plug may be realized.

a. First Embodiment

A-1. Configuration of Spark Plug:

FIG. 1 is a partial cross-sectional view of a spark plug 100 manufactured by a method for manufacturing a spark plug according to an embodiment of the present disclosure. As illustrated in FIG. 1, the spark plug 100 has a thin and long shape extending along an axial line Ax. In FIG. 1, an exterior front view of the spark plug 100 is shown on the right side of the axial line Ax, which is indicated by a dashed-dotted line. The left side of the axial line Ax illustrates a cross-sectional view of the spark plug 100 taken in a plane including the central axis of the spark plug 100. In the following description, the bottom of FIG. 1 in a direction parallel with the axial line Ax will be referred to as the front end side, and the top of FIG. 1 will be referred to as the rear end side.

The spark plug 100 is provided with an insulator 10, a center electrode 20, a ground electrode 30, a terminal metal fitting 40, and a metal shell 50. The center electrode 20 is in the form of a rod protruding from one end of the insulator 10. The center electrode 20 is electrically connected to the terminal metal fitting 40 provided at the other end of the insulator 10 through the inside of the insulator 10. The outer periphery of the center electrode 20 is held by the insulator 10. The outer periphery of the insulator 10 is held by the metal shell 50 at a position spaced apart from the terminal metal fitting 40.

The ground electrode 30 is electrically connected to the metal shell 50. Between the ground electrode 30 and the front end of the center electrode 20, a spark gap, which is a clearance where spark is generated, is formed. The spark plug 100 is installed in a threaded mount hole 201 provided in an engine head 200 of an internal combustion engine via the metal shell 50. When a high voltage of 20,000 to 30,000 volts is applied to the terminal metal fitting 40, spark is generated in the spark gap formed between the front end of the center electrode 20 and the ground electrode 30.

The insulator 10 is a tubular insulating member formed by sintering a ceramic material, such as alumina. The insulator 10 has an axial hole 12 concentrically formed therein. The axial hole 12 houses the center electrode 20 and the terminal metal fitting 40. The insulator 10 includes a front end body portion 17 on the center electrode 20 side and a rear end body portion 18 on the terminal metal fitting 40. The insulator 10 also includes a middle body portion 19 between the front end body portion 17 and the rear end body portion 18. The front end body portion 17 has a smaller outer diameter than the rear end body portion 18. The rear end body portion 18 is configured to insulate the terminal metal fitting 40 and the metal shell 50 from each other. The middle body portion 19 is formed at an axial middle of the insulator 10 and has a larger outer diameter than the other portions of the insulator 10. The insulator 10 further includes an insulator nose portion 13 at an end of the front end body portion 17, which is opposite to the middle body portion 19. The insulator nose portion 13 has a smaller outer diameter than the front end body portion 17, the outer diameter thereof gradually decreased toward the front end.

The metal shell 50 is a cylindrical metal shell. The metal shell 50 encloses and holds a portion of the insulator 10 from a part of the rear end body portion 18 to the insulator nose portion 13. According to the present embodiment, the metal shell 50 is formed of low-carbon steel. The metal shell 50 is entirely plated by nickel plating or zinc plating, for example. The metal shell 50 includes a tool engaging portion 51, a mounting thread portion 52, and a gasket-receiving portion 54.

The tool engaging portion 51 of the metal shell 50 is configured to fit with a tool (not shown) for installing the spark plug 100 on the engine head 200. The mounting thread portion 52 of the metal shell 50 has threads configured to be threadedly engaged in the threaded mount hole 201 of the engine head 200. The gasket-receiving portion 54 of the metal shell 50 is formed at the rear end side of the mounting thread portion 52 in a flange shape protruding from the outer periphery of the mounting thread portion 52 in a radial direction thereof.

A gasket 5 is fitted and inserted into the metal shell 50. The gasket 5 is a solid and substantially annular member, and abuts the end portion of the front end side of the gasket-receiving portion 54. The gasket 5 ensures the sealing between the gasket-receiving portion 54 of the spark plug 100 and the engine head 200. The detailed construction of the gasket 5 and its manufacturing method will be described later. The metal shell 50 has a circular front end surface 57 with an axial opening. At the center of the front end surface 57, the center electrode 20 protrudes from the insulator nose portion 13 of the insulator 10.

On the rear end side of the tool engaging portion 51 of the metal shell 50, a thin crimping portion 53 is provided. Between the gasket-receiving portion 54 and the tool engaging portion 51, a thin compressively deformed portion 58 is provided. Similarly, the crimping portion 53 is also provided with a thin compressively deformed portion 58. Between the inner peripheral surface of the metal shell 50 from the tool engaging portion 51 to the crimping portion 53, and the outer peripheral surface of the rear end body portion 18 of the insulator 10, annular ring members 6 and 7 are disposed. The gap between the ring members 6 and 7 is filled with talc powder 9.

When the spark plug 100 is manufactured, a crimping process is performed whereby the crimping portion 53 is bent inside and pressed toward the front end side, thereby compressively deforming the compressively deformed portion 58. By performing the crimping process, the insulator 10 is pressed toward the front end side in the metal shell 50 via the ring members 6 and 7 and the talc 9. The pressing causes the talc 9 to be compressed in the axial line Ax direction. As a result, the airtightness in the metal shell 50 is increased.

On the inner periphery of the metal shell 50, an insulator step part 15 is pressed onto a step part 56 in the metal shell formed at the position of the mounting thread portion 52 via an annular plate packing 8. The insulator step part 15 is positioned at the proximal end of the insulator nose portion 13 of the insulator 10. The plate packing 8 is a member for maintaining airtightness between the metal shell 50 and the insulator 10. The plate packing 8 prevents or suppresses the leakage of combustion gas.

The center electrode 20 is a rod-shaped member. Inside the electrode base material 21 contained in the center electrode 20, a core material 25 is embedded. The electrode base material 21 is formed in the shape of a bottomed tube. The core material 25 has higher thermal conductivity than the electrode base material 21. According to the present embodiment, the electrode base material 21 includes a nickel alloy composed chiefly of nickel. The core material 25 includes copper or an alloy composed chiefly of copper. The center electrode 20 is inserted in the axial hole 12 of the insulator 10 with the front end of the electrode base material 21 protruding from the axial hole 12 of the insulator 10. The center electrode 20 is electrically connected to the terminal metal fitting 40 via a ceramic resistance 3 and a sealing member 4.

The ground electrode 30 is a rod-shaped member with a proximal end being welded to the front end surface 57 of the metal shell 50. The front end side of the ground electrode 30 is bent in a direction intersecting the axial line Ax. The front end portion of the ground electrode 30 is disposed facing the front end surface of the center electrode 20 on the axial line Ax. At the position of the front end portion of the ground electrode 30 facing the center electrode 20, a noble metal tip 70 is disposed for increasing spark erosion resistance and oxidation wear resistance.

Figure 2:
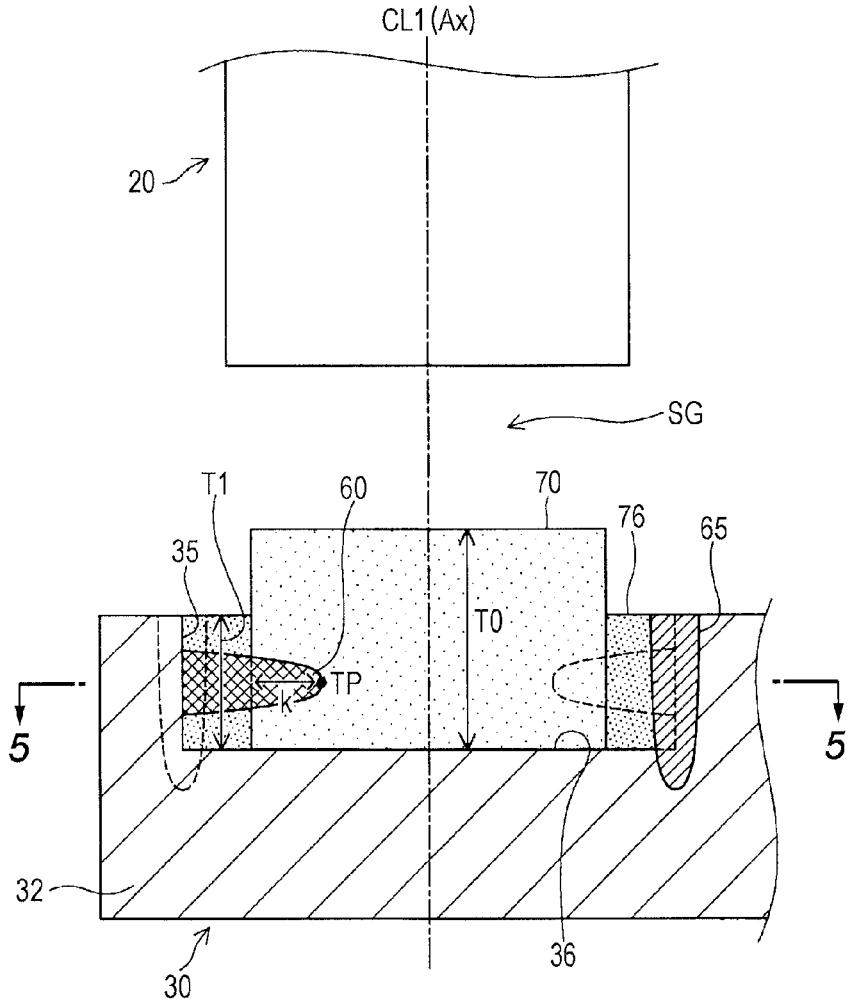
FIG. 2 is a cross-sectional view of a front end portion of a ground electrode, illustrating the configuration thereof.

A-2. Detailed Configuration of the Ground Electrode:

FIG. 2 is a cross-sectional view of the front end portion of the ground electrode 30, illustrating the configuration thereof. As illustrated in FIG. 2, the ground electrode 30 includes a base portion 32, a noble metal tip 70, and a holding member 76.

The base portion 32 is a rod-shaped member formed from, e.g., a high corrosion resistance metal, such as nickel or a nickel alloy. The base portion 32 includes a recess 35 at the front end thereof facing the center electrode 20 (at the position where a spark gap SG is formed; see FIG. 2). In the recess 35, a noble metal tip 70 and a holding member 76 are joined to the base portion 32. The recess 35 has a circular cross section and includes a flat bottom surface 36.

The noble metal tip 70 has a substantially cylindrical shape. The noble metal tip 70 is formed from a noble metal having high spark erosion resistance and oxidation resistance. According to the present embodiment, iridium or an iridium alloy composed chiefly of iridium is used as the noble metal. According to the present embodiment, the noble metal tip 70 has a diameter of 2 mm or more. The upper limit of the diameter of the noble metal tip 70 may be 10 mm, for example. According to the present embodiment, the central axis of the noble metal tip 70 (hereafter referred to as "tip center axis CL1") is substantially aligned with the axial line Ax of the spark plug 100. However, it is also possible to provide the noble metal tip 70 with a shape such that the tip center axis CL1 and the axial line Ax are not aligned.

The holding member 76, as an intermediate member, joins the noble metal tip 70 to the ground electrode 30. The holding member 76 has a substantially cylindrical shape, and the noble metal tip 70 is inserted in the hollow portion of the holding member. The holding member 76 may be formed from nickel or a nickel alloy composed chiefly of nickel. The holding member 76 according to the present embodiment corresponds to a "base material" in the claims.

According to the present embodiment, the internal diameter of the hollow portion of the holding member 76 and the diameter of the noble metal tip 70 may have a difference Δd1 of not less than 0.01 millimeter and not more than 0.1 millimeter. When Δd1 is greater than 0.1 millimeter, the clearance between the outer peripheral surface of the noble metal tip 70 and the inner peripheral surface of the holding member 76 is excessive. In this case, the joint strength between the noble metal tip 70 and the holding member 76 is decreased, and the efficiency of heat transfer from the noble metal tip 70 to the base portion 32 may be decreased. On the other hand, when Δd1 is smaller than 0.01 millimeter, when the noble metal tip 70 is inserted in the hollow portion of the holding member 76, the inner wall of the holding member 76 may be scraped by the noble metal tip 70, creating a burr on the inner wall of the holding member 76. In this case, an error may be caused in the position relationship between the noble metal tip 70 and the holding member 76, possibly resulting in a decrease in the joint strength between the noble metal tip 70 and the holding member 76.

As illustrated in FIG. 2, according to the present embodiment, a thickness T1 of the holding member 76 (length in the tip center axis CL1 direction) is smaller than a thickness T0 of the noble metal tip 70. In the recess 35 of the base portion 32, the noble metal tip 70 and the holding member 76 are both located in contact with the bottom surface 36 of the recess 35. The recess 35 has a depth substantially the same as the thickness T1 of the holding member 76. Thus, a part of the noble metal tip 70 (portion on the side facing the center electrode 20) is protruding from the surface of the holding member 76 and the base portion 32. The internal diameter of the recess 35 and the diameter of the holding member 76 may have a difference Δd2 of not less than 0.01 millimeter and not more than 0.1 millimeter, as in Δd1.

Figure 3A:
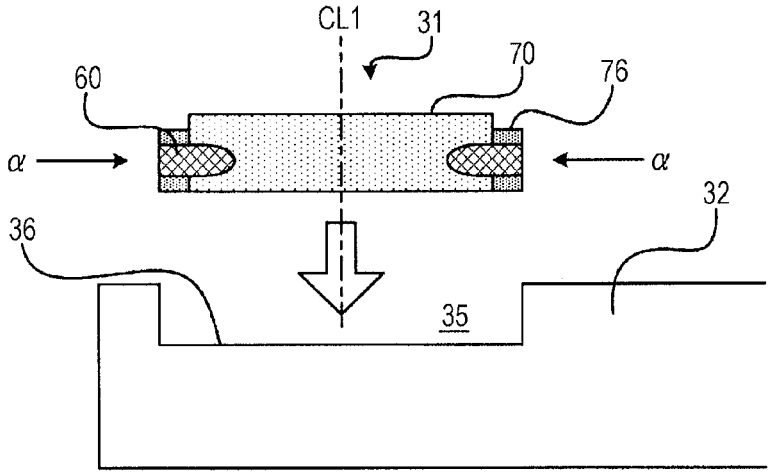
FIGS. 3A and 3B are explanatory diagrams illustrating the step of attaching a noble metal tip to a base portion, respectively.
Figure 3B:
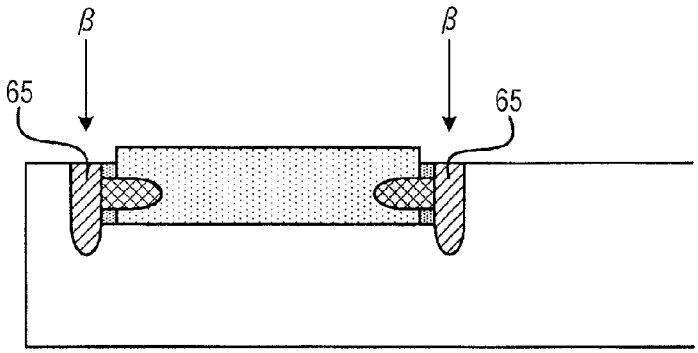

FIGS. 3A and 3B are explanatory diagrams illustrating the step of installing the noble metal tip 70 on the base portion 32. FIG. 3A illustrates how the noble metal tip 70 and the holding member 76 are joined, and the direction of laser irradiation (arrow head α). In the following description, the integrally joined noble metal tip 70 and holding member 76 will be referred to as "tip joined body 31". FIG. 3A further illustrates how the tip joined body 31 is embedded in the recess 35 of the base portion 32, as indicated by an outlined arrow head. FIG. 3B illustrates how the tip joined body 31 and the base portion 32 are joined, and also the direction of laser irradiation (arrow head β).

Thus, according to the present embodiment, the noble metal tip 70 is joined to the holding member 76 by laser welding, forming the tip joined body 31. The tip joined body 31 is joined to the base portion 32, whereby the noble metal tip 70 is indirectly joined to the base portion 32 (via the holding member 76).

As illustrated in FIG. 3A, according to the present embodiment, the noble metal tip 70 and the holding member 76 are joined to each other. Specifically, the noble metal tip 70 is joined to the hollow portion of the holding member 76 by laser welding while being inserted into the holding member 76. At this time, laser is irradiated toward the tip center axis CL1 from an outer periphery side, in a direction substantially vertical with respect to the tip center axis CL1. More specifically, laser welding is performed at a plurality of positions along the outer periphery of the holding member 76. By the laser welding, a plurality of fusion regions 60 (hereafter referred to as "first fusion regions 60") is formed. The first fusion regions 60 extend from the outer peripheral surface of the holding member 76 to the inside of the noble metal tip 70. As a result, the noble metal tip 70 and the holding member 76 are integrated. The first fusion regions 60 correspond to a "fusion region" in the claims.

As illustrated in FIG. 3B, according to the present embodiment, the tip joined body 31 is inserted in the recess 35. The tip joined body 31 is joined to the bottom surface 36 of the recess 35 by resistance welding. Further, the tip joined body 31 and the base portion 32 are laser-welded. The laser welding involves irradiating an area in the vicinity of the boundary of the outer periphery of the holding member 76 and the inner periphery of the recess 35 with laser. At this time, the direction of laser irradiation is toward the surface facing the center electrode 20 and in parallel with the tip center axis CL1. More specifically, by a plurality of fusion regions 65 (which may hereafter be referred to as "second fusion regions 65") formed by laser welding, the tip joined body 31 is joined to the ground electrode 30.

Figure 4:
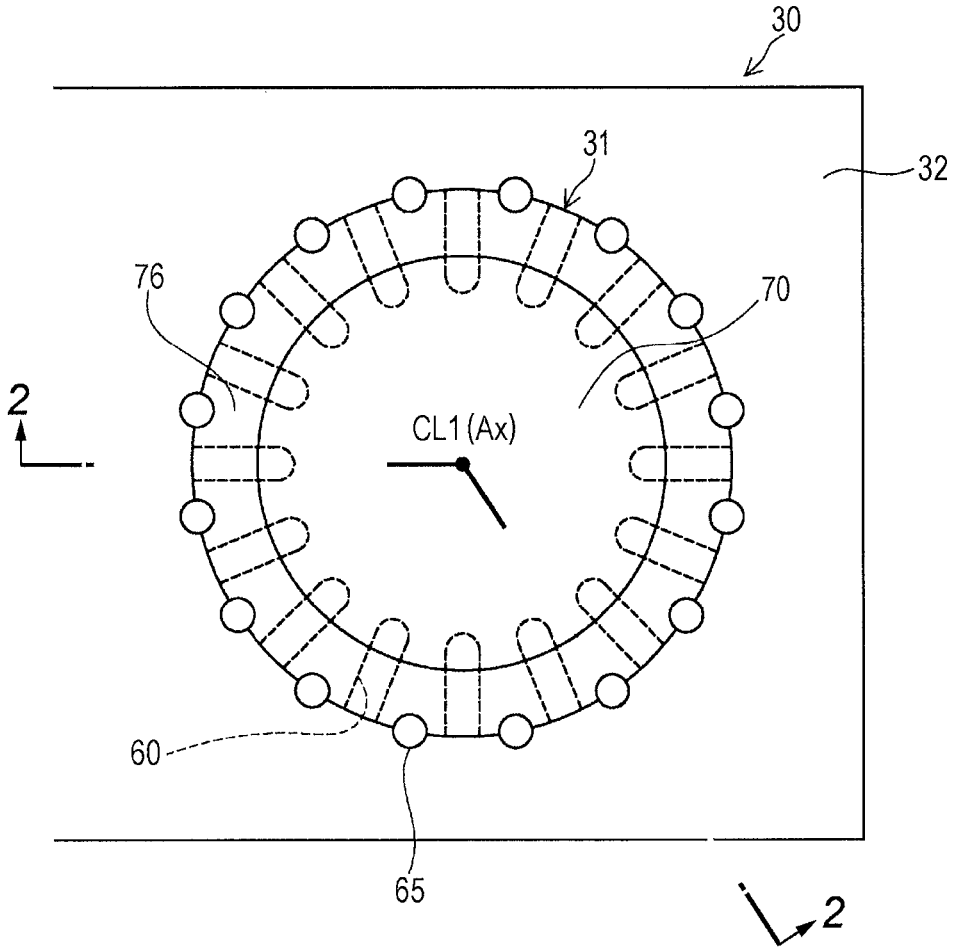
FIG. 4 is a plan view of a front end portion of the ground electrode.

FIG. 4 is a plan view of the front end portion of the ground electrode 30 on the side facing the center electrode 20. The cross-sectional view of FIG. 2 corresponds to a sagittal cross-sectional view taken along line 2-2 of FIG. 4. In FIG. 4, the positions of the first fusion regions 60 which are not shown on the surface of the ground electrode 30 are indicated by dashed lines. As illustrated in FIG. 4, according to the present embodiment, 16 first fusion regions 60 are provided. The first fusion regions 60 are formed at substantially uniform intervals.

According to the present embodiment, 16 second fusion regions 65 are provided. As illustrated in FIG. 4, the second fusion regions 65 are located at positions that do not interfere with the first fusion regions 60. Further, the second fusion regions 65 are disposed substantially uniformly (such as at 22.5° intervals about the tip center axis CL1). In FIG. 2, for the purpose of illustrating the position relationship between the first fusion regions 60 and the second fusion regions 65 and the like in the cross section, the first fusion regions 60 and the second fusion regions 65 that are not shown in the sagittal cross-sectional view taken along line 2-2 of FIG. 4 are indicated by dashed lines.

As illustrated in FIG. 2, the first fusion regions 60 are formed extending from the outer peripheral surface of the holding member 76 into the noble metal tip 70. In FIG. 2, in the first fusion regions 60, the point closest to the tip center axis CL1 is designated as a point TP.

Figure 5:
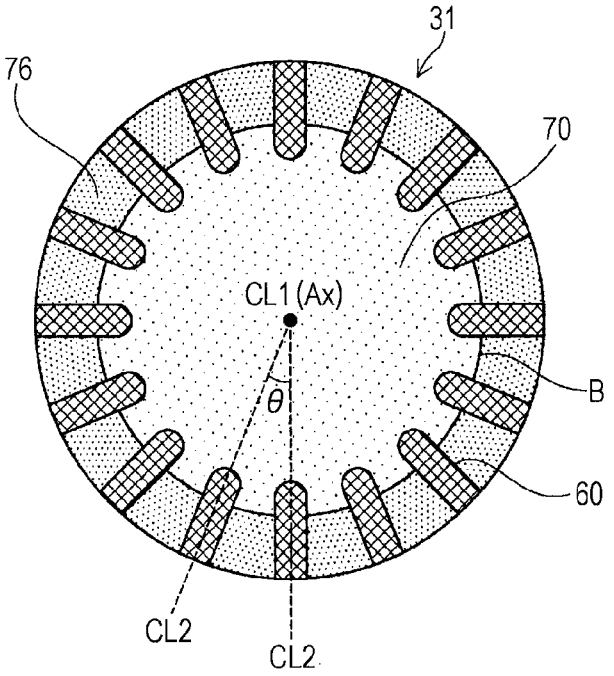
FIG. 5 is a cross-sectional view of a TP-containing cross section of a tip joined body.

FIG. 5 is a cross-sectional view of the tip joined body 31, illustrating a cross section perpendicular to the tip center axis CL1 and including the point TP. In the following description, the cross section perpendicular to the tip center axis CL1 and including the point TP may be referred to as a "TP-containing cross section". In FIG. 5, the second fusion regions 65 are omitted. The TP-containing cross section illustrated in FIG. 5 is a sagittal cross-sectional view taken along line 5-5 of FIG. 2.

As described above, according to the present embodiment, the first fusion regions 60 are formed by laser irradiation. The first fusion regions 60 are substantially uniformly disposed (at positions displaced at intervals of a constant angle θ about the tip center axis CL1). In order to form the first fusion regions 60, laser irradiation may be performed each the time noble metal tip 70 and the holding member 76 are rotated about the tip center axis CL1 by a predetermined angle when the noble metal tip 70 and the holding member 76 are joined. At this time, the height of laser irradiation (distance from the bottom surface of the noble metal tip 70 to the axis of laser irradiation along the direction of the tip center axis CL1) may be the same for each of the first fusion regions 60.

In FIG. 5, a line aligned with the laser irradiation axis for the first fusion regions 60 on the TP-containing cross section is indicated as a central axis CL2 of the first fusion regions 60. According to the present embodiment, as illustrated in FIG. 5, the central axes CL2 of the adjacent two of the first fusion regions 60 form a uniform angle θ°22.5°. While the angle may be non-uniform, it is advantageous to make the angle substantially uniform throughout the tip joined body 31 so as to achieve a uniform joint strength of the tip joined body 31 as a whole.

As described above, when the first fusion regions 60 are formed by performing laser irradiation toward the tip center axis CL1 from the outer periphery side of the holding member 76, in a direction substantially vertical with respect to the tip center axis CL1, the point TP is formed on the laser irradiation axis. In FIG. 2, the distance from the outer periphery of the noble metal tip 70 to the point TP is indicated by a fusion depth k. According to the present embodiment, substantially uniform energy is used for laser irradiation for forming the first fusion regions 60. Thus, the fusion depth k in each of the first fusion regions 60 is substantially uniform.

Figure 6:
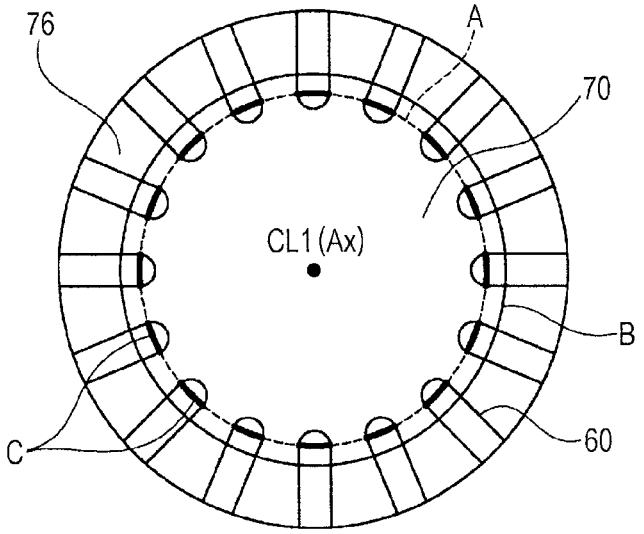
FIG. 6 is an explanatory diagram illustrating a feature of the ground electrode.
Figure 7:
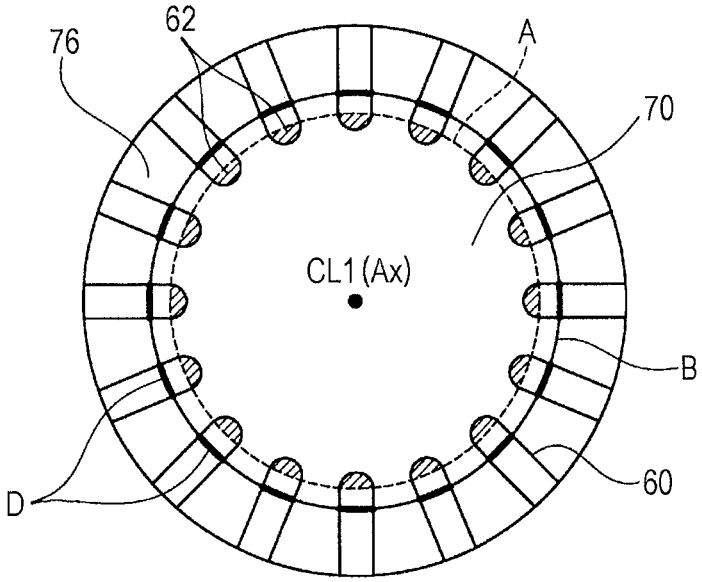
FIG. 7 is an explanatory diagram illustrating a feature of the ground electrode.

FIG. 6 and FIG. 7 are explanatory diagrams for describing a feature of the ground electrode 30 according to the present embodiment. FIG. 6 and FIG. 7 illustrate the TP-containing cross section of the tip joined body 31, as in FIG. 5. A concentric circle A illustrated in FIG. 6 and FIG. 7 is concentric with an outline of the noble metal tip 70 (virtual outer periphery of the noble metal tip 70 prior to welding), and is a circle with a diameter which is 90% of the length of the diameter of the noble metal tip 70. In FIG. 6 and FIG. 7, a concentric circle having the same diameter as the outline of the noble metal tip 70 (i.e., the virtual outer periphery of the noble metal tip 70 prior to welding) is indicated as a concentric circle B.

According to the present embodiment, each of the first fusion regions 60 is formed so as to extend beyond the concentric circle A toward the tip center axis CL1. In FIG. 7, the portion of each of the first fusion regions 60 that is formed beyond the concentric circle A toward the tip center axis CL1 (inside the concentric circle A) is indicated by hatching as central fusion portions 62.

The TP-containing cross section of the spark plug can be observed by the following operation. First, the tip joined body 31 is ground little by little from the side facing the center electrode 20 along the tip center axis CL1 in such a manner that a plane substantially vertical with respect to the tip center axis CL1 is exposed at all times. On the exposed plane substantially vertical with respect to the tip center axis CL1, the distance between the concentric circle B and the deepest portion of the first fusion regions 60 visible in the exposed plane is measured. This operation is repeated until the depth of the deepest portion is maximized. The tip joined body may be ground by a thickness of 5 μm at a time.

By the following operation, the distance between the concentric circle B and the deepest portion of the first fusion regions 60 in the cross section of the noble metal tip 70 with the exposed first fusion regions 60 can be measured. First, the cross section is imaged, and the image of the first fusion regions 60 is processed into thin lines by image processing. Then, the image of the first fusion regions 60 is linearly approximated by the least-square method and the like to derive the central axis CL2 of the first fusion regions 60. The distance between the point of intersection of the derived central axis CL2 and the concentric circle B and the point of intersection between the central axis CL2 and the deepest portion of the first fusion regions 60 is measured. As a result, the distance between the concentric circle B and the deepest portion of the first fusion regions 60 can be determined.

In FIG. 6, the portions of the first fusion regions 60 that are positioned on the concentric circle A (portion of the circumference of the concentric circle A that passes the first fusion regions 60) are indicated by thick lines as "first outer peripheral fusion portions C". According to the present embodiment, the total of the lengths of the first outer peripheral fusion portions C in the first fusion regions 60 is not less than 30% of the length of the circumference of the concentric circle A. That is, the ratio of the total length of the first outer peripheral fusion portions C in the first fusion regions 60 to the length of the circumference of the concentric circle A (which may hereafter be referred to as "the ratio over the concentric circle A") is not less than 30%. This sufficiently ensures the degree of extension of the first fusion regions 60 into the noble metal tip 70. As a result, the joint strength of the noble metal tip 70 and the holding member 76 can be increased.

However, as the ratio over the concentric circle A is increased, the amount of energy applied to the tip joined body 31 at the time of forming the first fusion regions 60 by laser irradiation is also increased. Thus, the tip joined body 31 tends to be overheated. Accordingly, in order to suppress the problem of deformation of the tip joined body 31 by overheating, it is preferable that the ratio over the concentric circle A is not more than 90% and more preferably not more than 85%.

In FIG. 7, the portions of the first fusion regions 60 that are positioned on the concentric circle B (portions of the circumference of the concentric circle B that pass the first fusion regions 60) are indicated by thick lines as "second outer peripheral fusion portions D". According to the present embodiment, the total of the lengths of the second outer peripheral fusion portions D in the first fusion regions 60 is not less than 30% of the length of the circumference of the concentric circle B. That is, the ratio of the total length of the second outer peripheral fusion portions D in the first fusion regions 60 to the length of the circumference of the concentric circle B (which may be hereafter referred to as "the ratio over the concentric circle B") is not less than 30%. This sufficiently ensures the degree of extension of the first fusion regions 60 into the noble metal tip 70. As a result, the joint strength of the noble metal tip 70 and the holding member 76 can be increased.

However, as the ratio over the concentric circle B is increased, the amount of energy applied to the tip joined body 31 at the time of laser irradiation for forming the first fusion regions 60 is increased. Thus, the tip joined body 31 tends to be overheated (high temperature). Accordingly, in order to suppress the problem of deformation of the tip joined body 31 due to overheating, the ratio over the concentric circle B is preferably not more than 90% and more preferably not more than 85%.

According to the present embodiment, in the first fusion regions 60, the content ratio of the metal constituting the noble metal tip 70 in the second outer peripheral fusion portions D of the TP-containing cross section is not more than 10 mass %. When the metal constituting the noble metal tip 70 is an alloy, the content ratio refers to the total mass % of the individual constituent elements in the alloy. The "content ratio of the metal constituting the noble metal tip 70 in the second outer peripheral fusion portions D of the TP-containing cross section" may be hereafter simply referred to as "the noble metal ratio in the second outer peripheral fusion portions D".

In the first fusion regions 60, the noble metal ratio in the second outer peripheral fusion portions D may be determined by the following operation, for example. First, as described above, the operation of grinding the tip joined body 31 from the surface, and the operation of measuring the distance between the concentric circle B and the deepest portion of the first fusion regions 60 are repeated, exposing the TP-containing cross section. Then, the second outer peripheral fusion portions D of the first fusion regions 60 in the TP-containing cross section are irradiated with an accelerated electron beam. This is followed by measurement of the composition of the first fusion regions 60 using an electron probe microanalyzer (EPMA)/wavelength dispersive X-ray spectrometer (WDS). According to the present embodiment, the noble metal ratio in the second outer peripheral fusion portions D in the first fusion regions 60 formed in the tip joined body 31 is not more than 10 mass %.

The composition of the first fusion regions 60 is normally substantially uniform throughout the first fusion regions 60. For example, a comparison of the content ratio of the metal constituting the noble metal tip 70 between the (deepest) portion closest to the tip center axis CL1 in the first fusion regions 60 and the portion of the first fusion regions 60 most spaced apart from the deepest location and in the vicinity of the outer periphery of the holding member 76 normally illustrates a variation of less than 2 mass %. According to the present embodiment, the second outer peripheral fusion portions D of the TP-containing cross section is defined as a reference position for measuring the content ratio of the metal constituting the noble metal tip 70 in the first fusion regions 60.

In the tip joined body 31, the greater the fusion depth k of the first fusion regions 60 (the distance between the outer periphery of the noble metal tip 70 and the point TP), the greater the effect of the joint strength increase by the formation of the first fusion regions 60. Thus, it is preferable that the fusion depth k of the first fusion regions 60 is greater than 5% of the diameter of the concentric circle B (the virtual outer periphery in the cross section of the noble metal tip 70 prior to melting).

However, from the viewpoint of containing the laser irradiation energy for welding, the fusion depth k is preferably less than 50% of the diameter of the concentric circle B and more preferably not more than 40%. Generally, when the noble metal tip 70 having the diameter on the order of 2 to 10 mm is used, the fusion depth k becomes not more than 30% of the diameter of the concentric circle B by keeping the noble metal ratio in the first fusion regions 60 at the second outer peripheral fusion portions D down to not more than 10 mass %.

As described above, the spark plug of the present embodiment has the following configurations (i) and (ii).

(i) Of the total length of the second outer peripheral fusion portions D in the first fusion regions 60, the ratio to the length of the circumference of the concentric circle B (the ratio over the concentric circle B) is not less than 30%.

(ii) Of the total length of the first outer peripheral fusion portions C in the first fusion regions 60, the ratio to the length of the circumference of the concentric circle A (the ratio over the concentric circle A) is not less than 30%.

Thus, even when the plurality of mutually spaced-apart first fusion regions 60 is provided using the noble metal tip 70 having a relatively large diameter of not less than 2 mm, the volume of the first fusion regions 60 formed in the noble metal tip 70 can be ensured. As a result, the joint strength between the noble metal tip 70 and the holding member 76 can be increased.

In the tip joined body 31, the number of times of laser irradiation for welding may be increased. For example, the plurality of first fusion regions 60 may be formed such that the adjacent first fusion regions 60 overlap each other by bringing the laser irradiation positions for forming the first fusion regions 60 closer to each other. As a result, the first fusion regions 60 may be shaped such that the first fusion regions 60 extend toward the tip center axis CL1 beyond the circumference of the concentric circle A (i.e., inside the circumference) throughout the circumference of the concentric circle A. However, when the number of times of laser irradiation is increased as described above, the energy applied to the tip joined body 31 by the irradiation may become excessive. As a result, a problem may be caused by overheating of the tip joined body 31.

According to the present embodiment, the configurations (i) and (ii) can limit the number of times of laser irradiation even when the noble metal tip 70 having a relatively large diameter of not less than 2 mm is used, while ensuring the volume of the first fusion regions 60 formed in the noble metal tip 70. Further, the joint strength between the noble metal tip 70 and the holding member 76 can be increased.

Further, according to the present embodiment, the plurality of mutually spaced-apart central fusion portions 62 is formed in the tip joined body 31, while satisfying the requirements of the configurations (i) and (ii). Thus, the effect of suppressing the fall of the noble metal tip 70 from the holding member 76 can be increased.

The material of the noble metal tip 70 and the material of the first fusion regions 60 have different linear expansion coefficients. Thus, as the spark plug 100 is exposed to a thermal cycle during its use, cracks may be caused in the boundary of the noble metal tip 70 and the first fusion regions 60. According to the present embodiment, the configuration (i) and (ii) ensure that the plurality of first fusion regions 60 is formed into the noble metal tip 70 in an embedded manner, ensuring a wider area of boundary between the portions of the noble metal tip 70 that are not melted and the first fusion regions 60. As a result, the fall of the noble metal tip 70 can be suppressed.

Figure 8A:
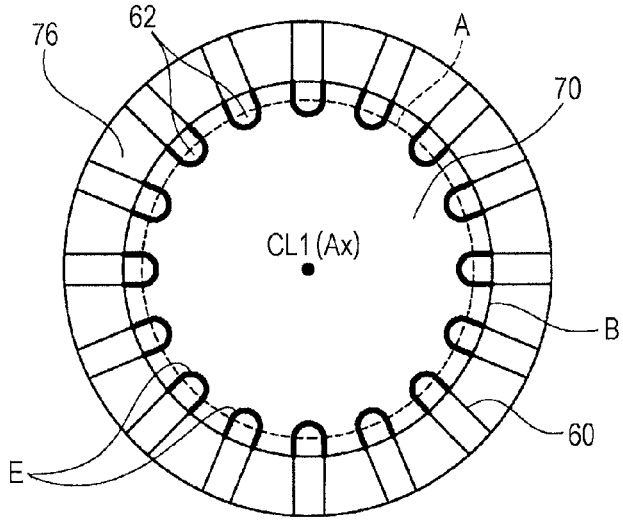
FIGS. 8A and 8B are explanatory diagrams illustrating boundary portions E, respectively, each of which is provided as a boundary between the noble metal tip and a first fusion region.
Figure 8B:
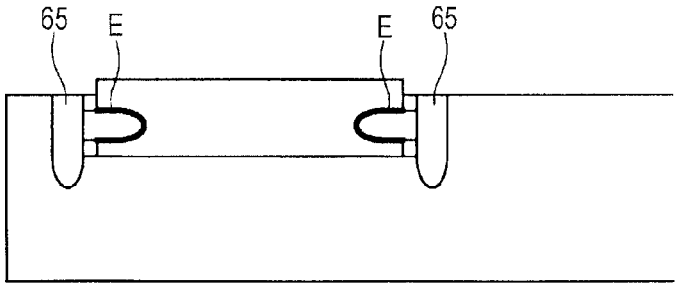

FIGS. 8A and 8B are explanatory diagrams illustrating boundary portions E between the noble metal tip 70 and the first fusion regions 60. FIG. 8A illustrates the TP-containing cross section. FIG. 8B illustrates a cross section including the first fusion regions 60 and the tip center axis CL1. The boundary portions E are formed in the noble metal tip 70 in the shape illustrated in FIGS. 8A and 8B (the shape fitted in the noble metal tip 70). As a result, even if cracks are caused in the boundary portions E as the spark plug 100 is exposed to a thermal cycle, the first fusion regions 60 can remain engaged with the noble metal tip 70 like wedges. Accordingly, the fall of the noble metal tip 70 from the holding member 76 can be suppressed.

Particularly, according to the present embodiment, the following configuration (iii) is provided.

(iii) In the first fusion regions 60, the content ratio of the metal constituting the noble metal tip 70 in the second outer peripheral fusion portions D of the TP-containing cross section (the noble metal ratio in the second outer peripheral fusion portions D) is not more than 10 mass %.

Thus, the difference in linear expansion coefficient between the material of the first fusion regions 60 and the material of the noble metal tip 70 is increased. On the other hand, the difference in linear expansion coefficient between the material of the first fusion regions 60 and the material of the holding member 76 is decreased.

As a result, when the spark plug 100 is exposed to a thermal cycle, cracks are more likely caused at the boundary portions E illustrated in FIGS. 8A and 8B than at the position corresponding to the second outer peripheral fusion portions D in FIG. 7 (the virtual outer periphery of the noble metal tip 70 prior to welding). When cracks are caused at the second outer peripheral fusion portions D illustrated in FIG. 7, the noble metal tip 70 becomes more likely to fall from the holding member 76. However, because cracks are more likely caused at the boundary portions E, the first fusion regions 60 are engaged with the noble metal tip 70 as described above. As a result, the fall of the noble metal tip 70 can be suppressed.

Further, according to the present embodiment, the configuration (iii) contains the laser irradiation energy for welding the noble metal tip 70 and the holding member 76. Thus, the tip joined body 31 can be prevented from overheating in the welding step. As a result, the problem of, e.g., deformation of the holding member 76 due to overheating can be suppressed.

A plurality of ground electrodes 30 having various values of the ratio over the concentric circle B and various ratios of the fusion depth k with respect to the diameter of the concentric circle B were fabricated. FIG. 9 illustrates the results of examining the joint strength between the noble metal tip 70 and the holding member 76 of the fabricated ground electrode 30. As shown in FIG. 9, three types of the tip joined body 31 were prepared, respectively having the ratio over the concentric circle B of 20%, 30%, and 50%. Further, the tip joined body 31 having the ratios of the fusion depth k of 2%, 5%, and 10% with respect to the diameter of the concentric circle B was prepared.

The number of the first fusion regions 60 formed in one tip joined body 31 was unified to 16. In order to examine the joint strength, a noble metal tip of iridium was used as the noble metal tip 70. As the holding member 76, a holding member of nickel was used.

The ratio over the concentric circle B and the ratio of the fusion depth k with respect to the diameter of the concentric circle B can be controlled by adjusting the output and time of laser irradiation for forming the first fusion regions 60. Various samples were fabricated by varying the output and time of laser irradiation. With respect to each sample, the ratio over the concentric circle B and the ratio of the fusion depth k with respect to the diameter of the concentric circle B in the TP-containing cross section were examined. Then, irradiation conditions under which the ratio over the concentric circle B and the ratio of the fusion depth k with respect to the diameter of the concentric circle B shown in FIG. 9 could be obtained were determined. Under the determined irradiation conditions, a sample was newly fabricated, and its joint strength was examined.

Spark plugs provided with the various types of the ground electrode 30 shown in FIG. 9 were fabricated. The spark plugs were then subjected to a vibration test to evaluate the joint strength. That is, each of the fabricated spark plugs was installed on an aluminum bush at tightening torque of 20N·m, the bush having been fabricated from the same aluminum material as the engine head. Thereafter, the vibration test was implemented in accordance with the ISO 11565, chapter 3.4.4. Specifically, vibrations were applied in the axial line Ax direction of the spark plug with the acceleration of 30 G±2G at the frequency of 50 to 500 Hz, with sweep rate 1 octave/min. A cycle of an operation of heating the spark plug using a burner and an operation of stopping the heating and cooling the spark plug was repeated.

The heating operation in each cycle was performed at 800° C. for two minutes. The cooling operation in each cycle was performed for one minute. Then, the number of cycles before the noble metal tip 70 fell was measured. In FIG. 9, the cases where the number of cycles before the fall of the noble metal tip 70 is less than 500 are indicated "Poor". The number of cycles before the fall was not less than 500 and less than 1000 is indicated "Good". The number of cycles before the fall was not less than 1000 is indicated "Excellent".

As shown in FIG. 9, it was confirmed that the joint strength can be significantly increased by making the ratio over the concentric circle B not less than 30%. However, when the ratio of the fusion depth k with respect to the diameter of the concentric circle B was 2%, the joint strength was insufficient even when the ratio over the concentric circle B was not less than 50%. By making the ratio of the fusion depth k with respect to the diameter of the concentric circle B not less than 5%, more sufficient joint strength could be obtained.

A plurality of ground electrodes 30 having a constant value of the ratio over the concentric circle B (30%), and various values of the ratio over the concentric circle A was fabricated. FIG. 10 illustrates the results of examination of the joint strength between the noble metal tip 70 and the holding member 76 of the fabricated ground electrodes 30. As shown in FIG. 10, three types of tip joined body 31 respectively having the ratio over the concentric circle A of 20%, 30%, and 50% were prepared. The conditions (such as constituent material) of the noble metal tip 70 and the holding member 76 used for fabricating the ground electrodes 30 were the same as those of the samples of which the results are shown in FIG. 9. The number of the first fusion regions 60 formed in one tip joined body 31 was unified to 16. The joint strength was examined by the same method as for the evaluation of the joint strength of which the results are shown in FIG. 9. The method of description of the joint strength evaluation results is also the same as that of FIG. 9.

Figures 11, 12:
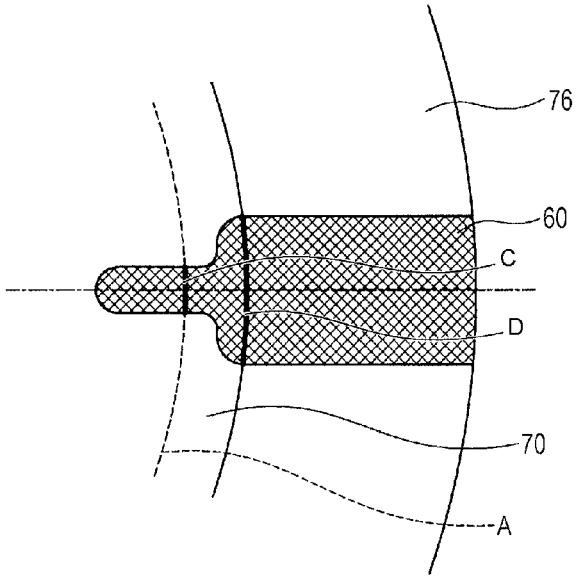
FIG. 11 is an explanatory diagram illustrating the shape of the first fusion region.
FIG. 12 is an explanatory diagram illustrating the results of an examination of the joint strength between the noble metal tip and a holding member.

FIG. 11 is an explanatory diagram illustrating the shape of the first fusion regions 60 in the samples of which the results are shown in FIG. 10 (the samples in which the ratios over the concentric circle A are 20% and 30%). When the sample having the ratio over the concentric circle A of 50% was fabricated, the laser irradiation for forming the first fusion regions 60 was performed at a constant output. Thus, the first fusion regions 60, as schematically illustrated in FIG. 5, are shaped with a substantially constant width except for the front end portion (proximate to the tip center axis CL1). On the other hand, in the samples having the ratio over the concentric circle A of 20% and 30%, as illustrated in FIG. 11, the first fusion regions 60 are shaped such that the width of the front end portion (closer to the tip center axis CL1 than the concentric circle B) is smaller than the width of the other portions.

In order to form the first fusion regions 60 of such shape, laser irradiation was initially performed with a first, larger output. As a result, the fusion region was formed into a deeper position in the noble metal tip 70, thus forming a portion including a thinner front end portion. Thereafter, the laser irradiation output was decreased to a lower, second output, thereby promoting the melting of the holding member 76, which had a lower melting point than the noble metal tip 70, while suppressing the melting of the noble metal tip 70. In this way, the width of the portions of the first fusion regions 60 that are formed in the holding member 76 was increased.

By adjusting the first and second outputs and the time of laser irradiation with each output, the ratio over the concentric circle B and the ratio over the concentric circle A can be can be controlled. By variously modifying the first and second outputs and the time of laser irradiation with each output, different samples were fabricated. With respect to each of the samples, the ratio over the concentric circle B and the ratio over the concentric circle A in the TP-containing cross section were examined. Then, irradiation conditions such that the ratio over the concentric circle B became 30% and the ratio over the concentric circle A became the values shown in FIG. 10 were determined. Under the determined conditions, a new sample was fabricated and its joint strength was examined.

As shown in FIG. 10, it was confirmed that the joint strength can be significantly increased by making the ratio over the concentric circle A not less than 30%.

A plurality of ground electrodes 30 having the ratio over the concentric circle B of 30%, the ratio of the fusion depth k with respect to the diameter of the concentric circle B of 5%, and various different values of the noble metal ratio in the second outer peripheral fusion portions D was fabricated. FIG. 12 illustrates the results of examination of the joint strength between the noble metal tip 70 and the holding member 76 of the fabricated ground electrode 30. As shown in FIG. 12, three types of tip joined body 31 respectively having the noble metal ratio in the second outer peripheral fusion portions D of 5 mass %, 10 mass %, and 11 mass % were prepared.

The conditions of the noble metal tip 70 (such as the constituent material) and the material of the holding member 76 used for fabricating the ground electrode 30 are the same as those of the samples of which the results are shown in FIG. 9. The number of the first fusion regions 60 formed in one tip joined body 31 was unified to 16. The joint strength was examined by the same method as that used for joint strength evaluation the results of which are shown in FIG. 9. The method of describing the results of the joint strength evaluation is also the same as in FIG. 9.

The ratio over the concentric circle B, the ratio of the fusion depth k with respect to the diameter of the concentric circle B, and the noble metal ratio in the second outer peripheral fusion portions D can be controlled by adjusting the output and time of laser irradiation for forming the first fusion regions 60, and the thickness of the holding member 76.

A plurality of samples of the ground electrodes 30 having the holding member 76 of various different thicknesses was fabricated while variously modifying the laser output and irradiation time. With respect to each sample, the ratio over the concentric circle B in the TP-containing cross section, the ratio of the fusion depth k to the diameter of the concentric circle B, and the noble metal ratio in the second outer peripheral fusion portions D were examined. Then, conditions such that the ratio over the concentric circle B and the ratio of the fusion depth k with respect to the diameter of the concentric circle B had the above values, and the noble metal ratio in the second outer peripheral fusion portions D had the values shown in FIG. 12 were determined. Under the determined conditions, a new sample was fabricated and its joint strength was examined. The heating temperature shown in FIG. 12 are those at the time of heating operation in accordance with the same joint strength evaluation method of which the results are shown in FIG. 9.

As shown in FIG. 12, it was confirmed that the joint strength of the ground electrode 30 can be significantly increased even when exposed to an extremely rigorous thermal cycle with the heating temperature of 1000° C., by making the noble metal ratio in the second outer peripheral fusion portions D not more than 10 mass %.

B. Second Embodiment

Figure 13:
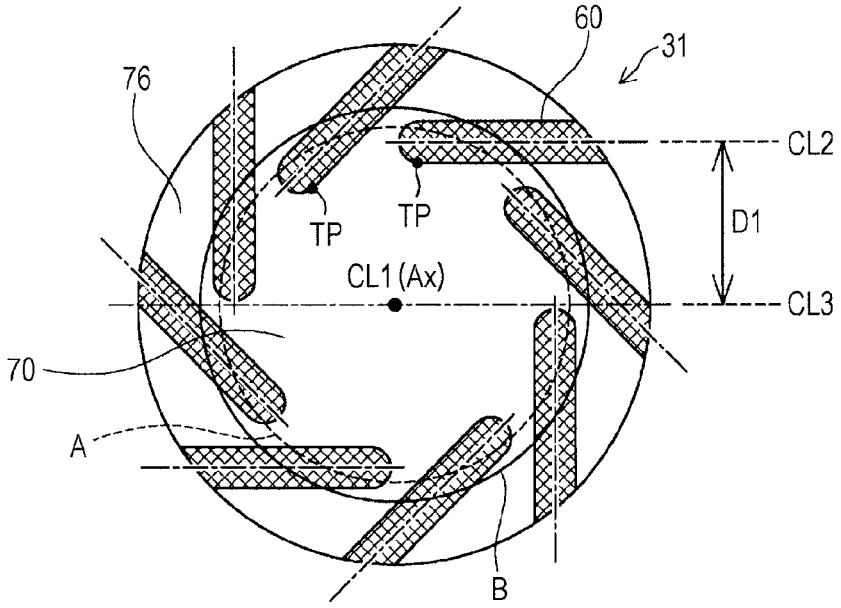
FIG. 13 is a cross-sectional view schematically illustrating the of tip joined body.

FIG. 13 is a cross-sectional view schematically illustrating the TP-containing cross section of the tip joined body 31 of the spark plug according to the second embodiment. In the following description of the embodiments including the second embodiment, portions common to those of the first embodiment will be designated with reference numerals similar to those of the first embodiment, while omitting the description of the common portions.

According to the second embodiment, as in the first embodiment, a plurality of mutually spaced-apart first fusion regions 60 is formed. However, as opposed to the first embodiment, the central axis CL2 of each of the first fusion regions 60 does not intersect the tip center axis CL1. That is, the central axis CL2 of the first fusion regions 60 and a line CL3 parallel with the central axis CL2 and intersecting the tip center axis CL1 are spaced apart from each other.

According to the second embodiment, a distance D1 between the central axis CL2 of the first fusion regions 60 and the corresponding line CL3 (which may be hereafter referred to as an offset amount D1) has a constant value. Specifically, in FIG. 13, the offset amount D1 is three-fourths the radius R of the noble metal tip 70 (radius R of the concentric circle B).

Further, according to the second embodiment, the first fusion regions 60 are disposed such that the central axis CL2 is positioned on the same side with respect to the corresponding line CL3 (i.e., the offset orientation is the same). That is, in the TP-containing cross section, all of the lines CL3 can be successively traced along a certain direction of rotation about the tip center axis CL1. The first fusion regions 60 are disposed such that, with respect to each line CL3, the corresponding central axis CL2 is positioned on the same side along the direction of rotation at all times.

In the second embodiment, the laser irradiation output, laser irradiation time, and the thickness of the holding member 76 are adjusted so as to obtain the configurations (i) to (iii) as in the first embodiment. That is, (i) the ratio over the concentric circle B of the first fusion regions 60 is not less than 30%; (ii) the ratio over the concentric circle A of the first fusion regions 60 is not less than 30%; and (iii) the noble metal ratio in the second outer peripheral fusion portions D of the first fusion regions 60 is not more than 10 mass %.

When the central axis CL2 of the first fusion regions 60 does not intersect the tip center axis CL1 as in the second embodiment, normally the point TP is not on the central axis CL2. The point TP herein refers to the point is closest to the tip center axis CL1 in the first fusion regions 60 (see FIG. 13). However, when the first fusion regions 60 are formed by constant output laser irradiation, normally, of the cross sections perpendicular to the tip center axis CL1, the cross section including the point TP corresponds to the cross section including the central axis CL2.

The spark plug according to the second embodiment configured as described above can provide the same effect as the effect according to the first embodiment. Further, according to the second embodiment, the central axis CL2 of the first fusion regions 60 and the line CL3 parallel with the central axis CL2 and intersecting the tip center axis CL1 are spaced apart from each other. Thus, the amount of energy (the amount of heat) applied to the tip joined body 31 as a whole by the laser irradiation for forming the first fusion regions 60 can be contained.

This is because the number of the first fusion regions 60 is decreased when the configurations (i) and (ii) are provided, compared with when the central axis CL2 and the tip center axis CL1 intersect with each other (the first embodiment illustrated in FIG. 5). As a result, the number of times of laser irradiation for forming the first fusion regions 60 can be kept small. That is, the central axis CL2 is formed at such an angle as to not intersect with the tip center axis CL1. Accordingly, even when the first fusion regions 60 with the same width are formed, the length of the second outer peripheral fusion portions D (see FIG. 7) and the length of the first outer peripheral fusion portions C (see FIG. 6) in the first fusion regions 60 become longer than when the central axis CL2 and the tip center axis CL1 intersect with each other (the first embodiment illustrated in FIG. 5).

As described above, the amount of energy applied to the tip joined body 31 at the time of laser irradiation for forming the first fusion regions 60 can be reduced. As a result, deformation of the holding member 76 by overheating can be prevented, whereby the durability of the ground electrode 30 can be increased.

That is, if the holding member 76 is deformed, when the ground electrode 30 is fabricated by welding the tip joined body 31 to the base portion 32, clearance may be caused between the tip joined body 31 and the base portion 32 (inner wall surface of the recess 35). When there is the clearance between the tip joined body 31 and the base portion 32, the efficiency of heat transfer between the tip joined body 31 and the base portion 32 is decreased. As a result, as the spark plug is used and the ground electrode 30 is exposed to a thermal cycle, the noble metal tip 70 or the tip joined body 31 could be overheated.

If the overheating is caused, cracks tend to be generated between portions of different constituent materials (i.e., having different linear expansion coefficients). Further, as the constituent material undergoes oxidation, the noble metal tip 70 and the tip joined body 31 becomes more likely to fall. The deformation of the holding member 76 also decreases the accuracy of installation of the holding member 76 with the noble metal tip 70 joined thereto in the recess 35 of the base portion 32. As a result, the joint strength (durability) of the tip joined body 31 could be decreased. According to the second embodiment, these problems can be suppressed by reducing the amount of energy applied to the tip joined body 31 at the time of laser irradiation.

The greater the distance D1 (offset amount D1) between the central axis CL2 and the corresponding line CL3 is, the longer the second outer peripheral fusion portions D and the first outer peripheral fusion portions C in each of the first fusion regions 60 become. Thus, the number of times of laser irradiation sufficient for providing the configurations (i) and (ii) can be decreased. From the viewpoint of suppressing the deformation of the holding member 76 by keeping down the number of times of laser irradiation, it is preferable that the offset amount D1 is not less than one-half of the radius R of the noble metal tip 70 (radius R of the concentric circle B). Preferably, the offset amount D1 is a value smaller than the radius R of the noble metal tip 70 and as large as possible as long as the configurations (i) and (ii) can be provided.

Figure 14:
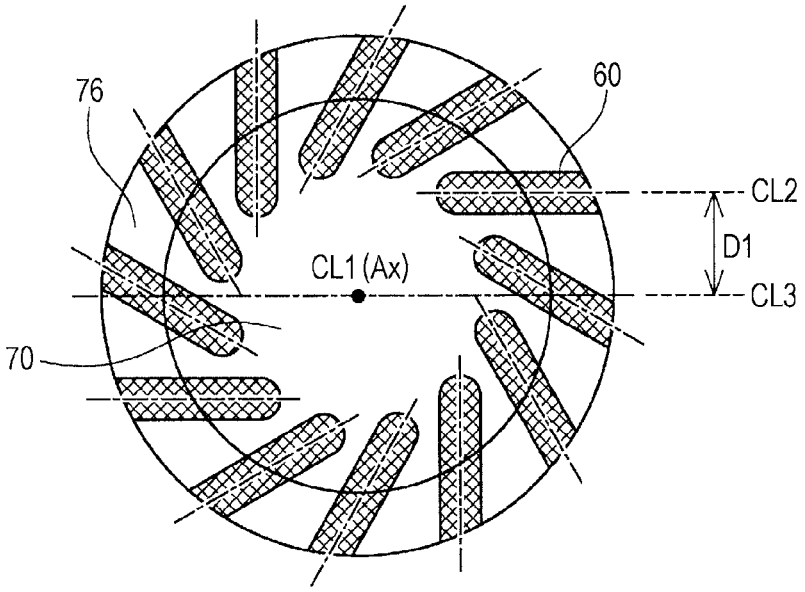
FIG. 14 is a cross-sectional view of a TP-containing cross section.
Figure 15:
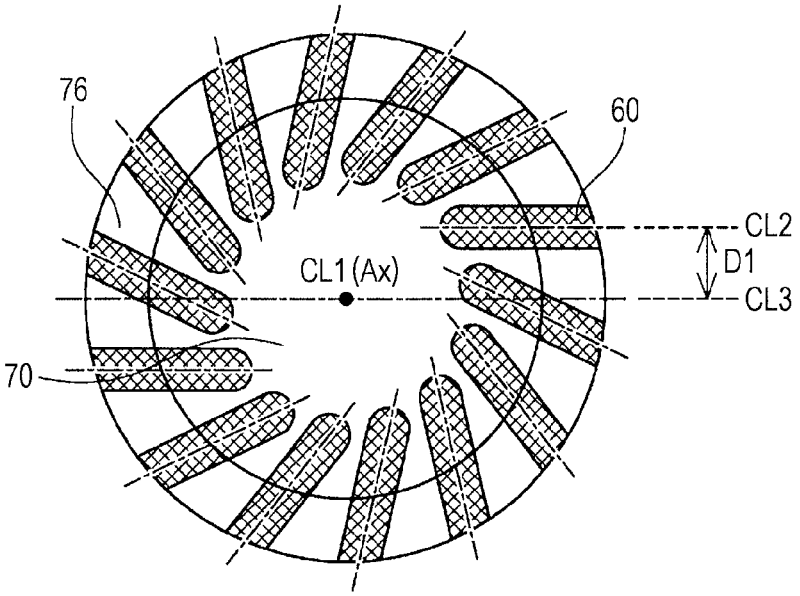
FIG. 15 is a cross-sectional view of a TP-containing cross section.

FIG. 14 is a cross-sectional view of a TP-containing cross section of a sample having the offset amount D1, which is one-half the radius R of the noble metal tip 70. FIG. 15 is a cross-sectional view of a TP-containing cross section of a sample having the offset amount D1, which is one-third the radius R of the noble metal tip 70.

The samples illustrated in FIG. 13, FIG. 14, and FIG. 15 all have the predetermined values of the offset amount D1. Further, in each of the samples, common laser irradiation conditions are set so as to provide the configurations (i) and (ii). Under these conditions, laser irradiation for forming one first fusion region 60 was performed. In each of the samples, the first fusion regions 60 were formed such that the offset amount D1 satisfied the above values and the distance between the adjacent first fusion regions 60 was substantially uniform.

C. Third Embodiment

Figure 16:
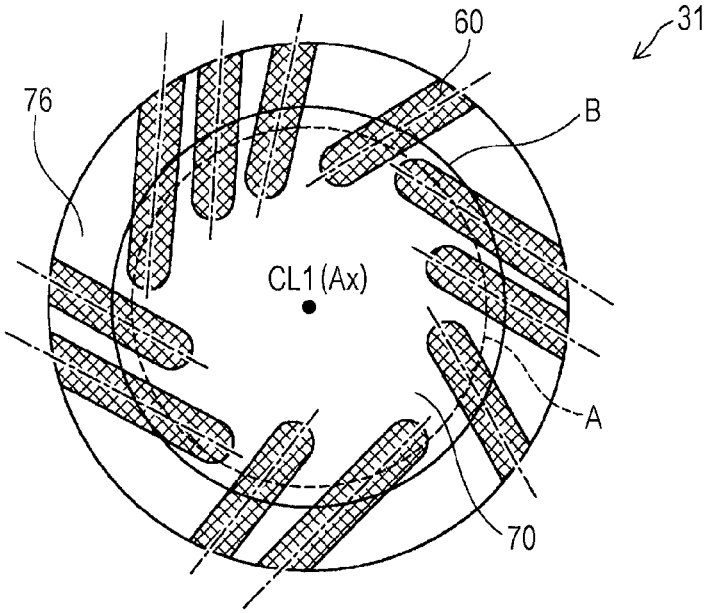
FIG. 16 is a cross-sectional view of a TP-containing cross section.

FIG. 16 is a cross-sectional view of a TP-containing cross section of the tip joined body 31 according to the third embodiment. The third embodiment is provided with the configurations (i) to (iii), as in the second embodiment. Further, the central axis CL2 of the first fusion regions 60 and the line CL3 parallel with the central axis CL2 and intersecting the tip center axis CL1 are spaced apart from each other. However, according to the third embodiment, the offset amount D1 in each of the first fusion regions 60 is not uniform throughout the tip joined body 31.

This configuration can also provide the same effect as the second embodiment. However, from the viewpoint of ensuring a substantially uniform joint strength between the noble metal tip 70 and the holding member 76 of the tip joined body 31 as a whole, it is preferable that, as in the second embodiment, the offset amount D1 is substantially uniform throughout the tip joined body 31.

D. Fourth Embodiment

Figure 17:
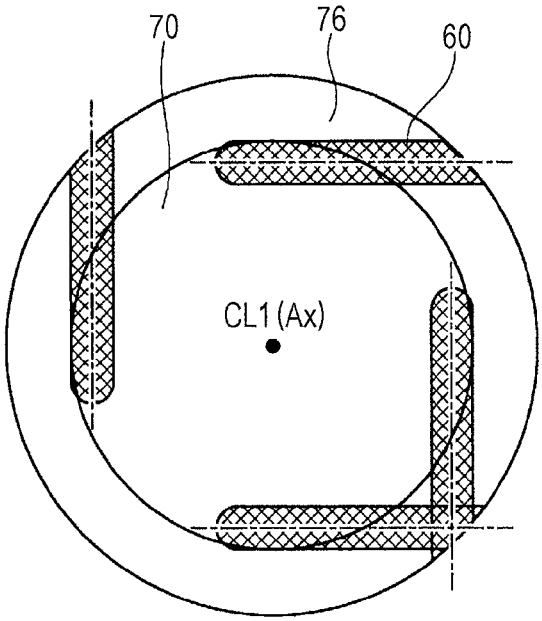
FIG. 17 is a cross-sectional view of a TP-containing cross section.

FIG. 17 is a cross-sectional view of a TP-containing cross section of the tip joined body 31 according to the fourth embodiment. The fourth embodiment is provided with the configurations (i) to (iii), as in the second and third embodiments. Further, the central axis CL2 of the first fusion regions 60 and the line CL3 parallel with the central axis CL2 and intersecting the tip center axis CL1 are spaced apart from each other.

However, the fourth embodiment differs from the second and third embodiments in that the central axis CL2 of the first fusion regions 60 is not disposed on the same side with respect to the corresponding line CL3. That is, the central axis CL2 of the first fusion regions 60 is disposed on a different side with respect to the corresponding line CL3. That is, a plurality of first fusion regions 60 with different offset orientations is provided.

This configuration can also provide the same effect as the second and third embodiments. However, providing the plurality of first fusion regions 60 with the different offset orientations may produce a portion with overlapped first fusion regions 60 particularly in the vicinity of the boundary of the holding member 76 and the noble metal tip 70. In such a portion, the noble metal ratio may be greatly modified, resulting in a larger difference in linear expansion coefficient. As a result, cracks may be more likely caused.

In order to avoid this, it is possible to provide a plurality of first fusion regions 60 having different offset orientations such that the first fusion regions 60 do not overlap each other. However, in this case, the density and joint strength of the first fusion regions 60 may become non-uniform in the tip joined body 31 as a whole. It also becomes difficult to provide the configurations (i) and (ii). As long as the offset orientation is the same, the laser irradiation for forming the plurality of the first fusion regions 60 can be performed while the holding member 76 with the noble metal tip 70 fitted therein is rotated in a constant direction. Thus, processability is increased. However, when the offset orientation is varied, the laser irradiation operation becomes more complex.

Thus, it is preferable that the offset orientation is the same as in the first to third embodiments.

E. Fifth Embodiment

Figure 18:
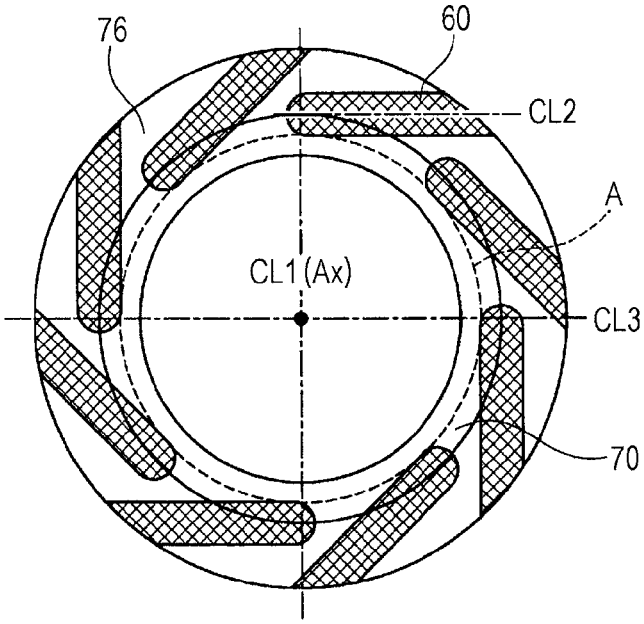
FIG. 18 is a cross-sectional view of a TP-containing cross section.

FIG. 18 is a cross-sectional view of a TP-containing cross section of the tip joined body 31 according to the fifth embodiment. The fifth embodiment is provided with the configurations (i) to (iii) as in the second and third embodiment. Further, the central axis CL2 of the first fusion regions 60 and the line CL3 parallel with the central axis CL2 and intersecting the tip center axis CL1 are spaced apart from each other. However, in the fifth embodiment, the noble metal tip 70 is formed in annular shape rather than a columnar shape. This configuration can also provide the same effect as the second and third embodiments.

F. Sixth Embodiment

Figure 19:
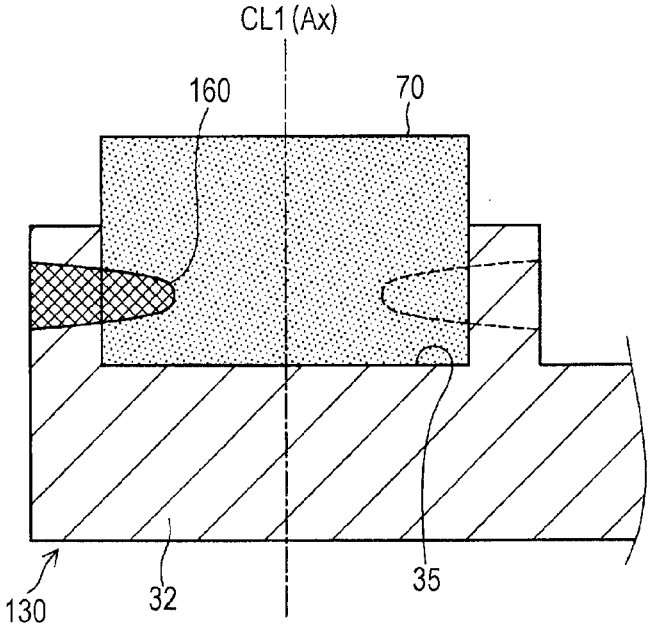
FIG. 19 is a cross-sectional view of a cross section including a tip center axis CL1.

FIG. 19 is a cross-sectional view of a cross section including a tip center axis CL1 of the front end portion of a ground electrode 130 according to the sixth embodiment. In the ground electrode 130 of the sixth embodiment, as opposed to the first to fifth embodiments, the noble metal tip 70 is directly welded to the base portion 32 without interposing the holding member. That is, in the sixth embodiment, the base material to which the noble metal tip 70 is welded is not the holding member 76 but the base portion 32.

Specifically, the noble metal tip 70 is laser-welded to the base portion 32 while being inserted in the recess 35 of the base portion 32. At this time, the laser is irradiated from the from the outer periphery side toward the tip center axis CL1 so as to form first fusion regions 160. This configuration can also provide the same effect as the first embodiment based on the configurations (i) and (ii) and additionally (iii).

G. Seventh Embodiment

Figure 20:
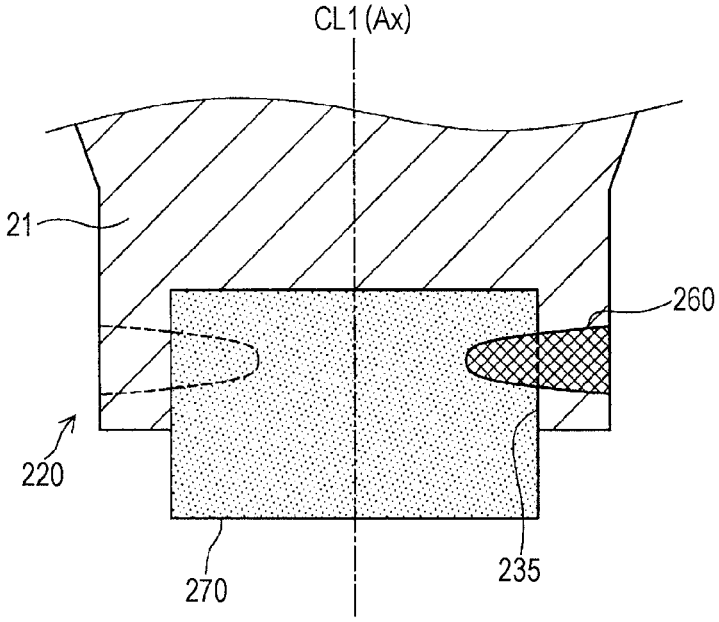
FIG. 20 is a cross-sectional view of a front end portion of the center electrode.

FIG. 20 is a cross-sectional view of the front end portion of a center electrode 220 according to the seventh embodiment. As illustrated in FIG. 20, the configuration regarding the welding of the electrode tip may be applied to the center electrode side instead of, or in addition to, the ground electrode 30. In the center electrode 220 illustrated in FIG. 20, a noble metal tip 270 is disposed in a recess 235 provided at the front end portion of the electrode base material 21 (see FIG. 1). The noble metal tip 270 is welded to the electrode base material 21 by irradiating laser from the outer periphery side toward the tip center axis CL1. Between the noble metal tip 270 and the electrode base material 21, first fusion regions 260 are formed by the laser welding.

This configuration can also provide the same effect as the foregoing embodiments based on the configurations (i) and (ii) and additionally (iii). In FIG. 20, the noble metal tip 270 and the electrode base material 21 are welded in direct contact with each other. However, the holding member 76 may be used as the base material to which the noble metal tip is welded, as in the first to fifth embodiments. In this case, the holding member 76 is disposed between the noble metal tip 270 and the electrode base material 21.

H. Modifications

The embodiments of the present disclosure are not limited to the foregoing implementation examples or embodiments. Other various embodiments may be made without departing from the scope and spirit of the present disclosure. For example, the following modifications are possible.

First Modification (Modification of the Metal Constituting the Noble Metal Tip):

In the foregoing embodiments, the noble metal tip is formed by iridium or iridium alloy. The noble metal tip may be formed using a different noble metal or a noble metal alloy. For example, the noble metal tip may be formed from a noble metal selected from platinum, ruthenium, and rhodium, or an alloy composed chiefly of such noble metals.

Among those noble metals, iridium has the minimum linear expansion coefficient. Thus, when iridium or an iridium alloy is used, the difference in linear expansion coefficient between the noble metal tip and the base material to which the noble metal tip is welded or the first fusion region becomes particularly large. As a result, cracks tend to be readily formed in the vicinity of the outer periphery of the noble metal tip. Accordingly, the noble metal tip including iridium or an iridium alloy can provide the effect of suppressing the fall of the noble metal tip particularly significantly by being provided with the configurations (i) and (ii), and further additionally (iii).

Second Modification (Modification of Welding Method):

The welding between the noble metal tip and the base material may be performed by welding other than the laser welding performed in the foregoing embodiments, such as arc welding or electron beam welding. The technology according to the present disclosure can be applied as long as the welding can be performed by irradiating energy from the outer periphery of the base material toward the noble metal tip, and the first fusion regions can be formed along the irradiation axis.

Third Modification (Modification of the Composition of the First Fusion Region):

In the foregoing embodiments, in the first fusion region, the content ratio of the metal constituting the noble metal tip 70 in the second outer peripheral fusion portions D of the TP-containing cross section is not more than 10 mass % (configuration (iii)). The content ratio may be varied. Even without the configuration (iii), the effect described above can be obtained by providing at least the requirements of the configurations (i) and (ii). That is, even when the noble metal tip having a relatively large diameter of not less than 2 mm is used, the durability of the spark plug can be increased by increasing the joint strength of the noble metal tip.

Fourth Modification (Modification of the Shape of the First Fusion Region):

In the foregoing embodiments, the first fusion regions include a plurality of mutually spaced-apart independent fusion portions. However, the first fusion regions may have mutually overlapping regions rather than being completely spaced apart from each other. Specifically, adjacent first fusion regions may be formed in the base material, such as the holding member 76, with mutually overlapping regions. The first fusion regions may be continuously provided in the tip joined body 31 as a whole. It is also possible to make the fusion depth k (see FIG. 2) in the first fusion regions of the noble metal tip as a whole non-uniform.

In each case, the modification can provide the same effect as the foregoing embodiments as long as the first fusion regions are provided with the plurality of central fusion portions formed in a region closer to the tip center axis CL1 than the concentric circle A, and as long as the configurations (i) and (ii), and additionally (iii) are provided.

Figure 21:
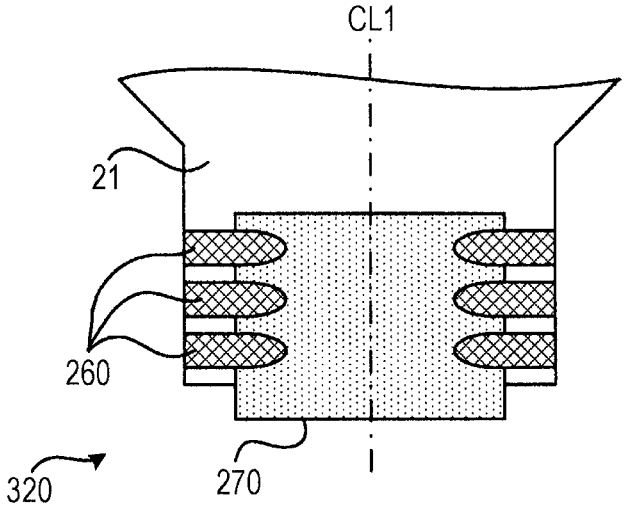
FIG. 21 is a cross-sectional view of a cross section including a tip center axis CL1.

Fifth Modification (Modification of the Location of the First Fusion Regions):

FIG. 21 is a cross-sectional view of a cross section including the tip center axis CL1 in a center electrode 320 according to another modification. In the foregoing embodiments, the first fusion regions include a plurality of first fusion regions subjected to laser irradiation at the same height. The "height of laser irradiation" herein refers to the distance from the bottom surface of the noble metal tip to the laser irradiation axis along the tip center axis CL1 direction. In the modification illustrated in FIG. 21, a plurality of stages of a plurality of first fusion regions that are subjected to laser irradiation at the same height is provided along the tip center axis CL1.

This configuration can also provide the same effect as the foregoing embodiments by providing each group of the plurality of first fusion regions subjected to laser irradiation at the same height with the configurations (i) and (ii), and additionally (iii). This configuration may be applied to the ground electrode. As the base material for welding, a holding member may be used.

The present disclosure is not limited to the above embodiments, implementation examples, or modifications, and may be realized in various configurations without departing from the scope and spirit of the disclosure. For example, the technical features in the embodiments, implementation examples, or modifications corresponding to the technical features in the embodiments described in the foregoing (1) to (5) may be substituted or combined as needed so as to solve some or all of the aforementioned problems, or to achieve some or all of the above effects. The technical features may be deleted as needed unless described as being indispensable in the present specification.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A spark plug comprising:

an electrode that includes a noble metal tip and a base material, wherein the noble metal tip is formed in a circular cross-sectional shape and contains a noble metal, the base material is disposed around an outer periphery of the noble metal tip, the noble metal tip is welded to the base material to form a fusion region extending from the base material to the noble metal tip, the noble metal tip has a diameter of not less than 2 mm, in a cross section perpendicular to a central axis CL1 of the noble metal tip and passing a point closest to the central axis CL1 in the fusion region, the fusion region includes a plurality of central fusion portions formed at an inner side with respect to a circumference of a circle A concentric to an outline of the noble metal tip, the concentric circle A having a diameter corresponding to a length of 90% of the diameter of the noble metal tip, a concentric circle B is a circle concentric to the outline of the noble metal tip and having the same diameter as the noble metal, a total of lengths on the concentric circle A passing through the fusion region is not less than 30% of the length of the circumference thereof, and a total of lengths on the concentric circle B passing through the fusion region is not less than 30% of the length of the circumference thereof, and in the fusion region, a content ratio of a metal constituting the noble metal tip in a portion overlapping the circumference of the concentric circle B in the cross section is not more than 10 mass %.

2. The spark plug according to claim 1, wherein:

the fusion region includes a plurality of mutually spaced-apart independent fusion portions including any of the central fusion portions, and in the cross section, a central axis CL2 of each of the independent fusion portions is spaced apart from a corresponding line CL3 parallel with the central axis CL2 and passing through the central axis CL1 of the noble metal tip.

3. The spark plug according to claim 2, wherein the central axis CL2 of each of the independent fusion portions is spaced apart on the same side with respect to the line CL3 in a direction of rotation about the central axis CL1.

4. The spark plug according to claim 1, wherein the noble metal tip is formed from iridium or an iridium alloy.

5. The spark plug according to claim 1, wherein:

the fusion region includes a plurality of mutually spaced-apart independent fusion portions including any of the central fusion portions, and in the cross section, a central axis CL2 of each of the independent fusion portions is spaced apart from a line parallel with the central axis CL2 and passing the central axis CL1 of the noble metal tip.

6. The spark plug according to claim 1, wherein the noble metal tip is formed from iridium or an iridium alloy.

7. The spark plug according to claim 2, wherein the noble metal tip is formed from iridium or an iridium alloy.

8. The spark plug according to claim 3, wherein the noble metal tip is formed from iridium or an iridium alloy.

9. The spark plug according to claim 5, wherein the noble metal tip is formed from iridium or an iridium alloy.

* * * * *